United States Patent [19]

Adam et al.

[11] Patent Number: 4,734,130

[45] Date of Patent: Mar. 29, 1988

[54] METHOD OF PRODUCING RAPIDLY SOLIDIFIED ALUMINUM-TRANSITION METAL-SILICON ALLOYS

[75] Inventors: Colin M. Adam, Morristown, N.J.; Kenji Okazaki, Lexington, Ky.; David J. Skinner, Flanders, N.J.; Robert G. Corey, Murrells Inlet, S.C.

[73] Assignee: Allied Corporation, Morris Township, Morris County, N.J.

[21] Appl. No.: 639,300

[22] Filed: Aug. 10, 1984

[51] Int. Cl.[4] ..... C22C 1/04

[52] U.S. Cl. ..... 75/68 A; 148/437; 420/548; 420/549

[58] Field of Search ..... 148/437, 438, 439, 440; 420/534, 535, 537, 543, 544, 546, 548, 549; 75/68 R, 68 A

[56] References Cited

U.S. PATENT DOCUMENTS

| | | | |
|---|---|---|---|
| 3,661,561 | 5/1972 | Frey, Jr. et al. | 75/68 A |
| 3,661,562 | 5/1972 | Seth et al. | 75/68 R |
| 3,758,289 | 9/1973 | Wood, Jr. | 75/10 |
| 3,758,290 | 7/1974 | Kibby | 75/10 R |
| 4,046,558 | 9/1977 | Das et al. | 75/68 A |
| 4,053,303 | 10/1977 | Cochran et al. | 75/68 A |
| 4,347,076 | 8/1982 | Ray et al. | 148/437 |
| 4,394,167 | 7/1983 | Kuwahara | 75/68 A |

OTHER PUBLICATIONS

E. L. Singleton, et al., "Recovery of Aluminum From Aluminum-Silicon Alloys", Bureau of Mines Report of Investigations/1972, pp. 1-12.

P. Van Mourik, et al., "On Precipitation in Rapidly Solidified Aluminum-Silicon Alloys", Journal of Materials Science, 1983, pp. 2706-2720.

R. O. Suzuki, et al., "Formation and Crystallization of Al—Fe—Si Amorphous Alloys", Journal of Materials Science, 1983, pp. 1195-1201.

P. T. Stroup, "Carbothermic Smelting of Aluminum", The 1964 Extractive Metallurgy Lecture, vol. 230, pp. 356-372.

Fujishige, et al., "Carbothermic Reduction of Aluminous Compounds Under the High Temperature CO Gas Flow", J. Japan Inst. Metals, vol. 47, 1983 pp. 1047-1054.

*Primary Examiner*—R. Dean

*Attorney, Agent, or Firm*—Ernest D. Buff; Gerhard H. Fuchs

[57] ABSTRACT

The present invention provides a method for producing an aluminum alloy which includes the step of carbothermically reducing an aluminous material to provide an alloy consisting essentially of the formula $Al_{bal}TM_dSi_e$, wherein TM is at least one element selected from the group consisting of Fe, Ni, Co, Ti, V, Zr, Cu and Mn, "d" ranges from about 2-20 wt %, "e" ranges from about 2.1-20 wt %, and the balance is aluminum and incidental impurities. The alloy is placed in the molten state and rapidly solidified at a quench rate of at least about $10^6$K/sec to produce a rapidly solidified alloy composed of a predominately microeutectic and/or microcellular structure.

5 Claims, 6 Drawing Figures

METHOD OF PRODUCING RAPIDLY SOLIDIFIED ALUMINUM-TRANSITION METAL-SILICON ALLOYS

BACKGROUND OF THE INVENTION

1. Field of The Invention

The invention relates to aluminum-transition metal-silicon alloys produced by the carbothermic reduction of aluminous ores containing silica, and metal oxides, such as iron or titanium oxides. More particularly, the invention relates to carbothermically reduced aluminum-iron-silicon alloys that have been rapidly solidified from the melt and thermomechanically processed into structural components having a combination of high ductility (toughness) and high tensile strength.

2. Brief Description of The Prior Art

P. Van Mourik, et al. in the article "On Precipitation in Rapidly Solidified Aluminum-Silicon Alloys", Journal of Materials Science 18 (1983), pp. 2706–2720;discusses the precipitation of Si in rapidly solidified Al—Si alloys. The alloys were prepared by mixing selected proportions of substantially pure Al and Si, and then melt spinning the molten alloys compositions at a quench rate ranging from $10^6$ to $10^7$ K/sec, as particularly discussed at page 2707 thereof.

R. 0. Suzuki, Y. Komatsu, K. F. Kobayashi, P. H. Shingu ("Al—Fe—Si Alloys", Journal Materials Science, Vol. 18, 1983, pp. 1195–1201) have investigated amorphous Al—Fe—Si alloys produced by the gun method and by single roller quenching. Specifically, compositions near the $\beta$-$Al_9Fe_2Si_2$ intermetallic compound (Al—13wt. % Fe—17.4 wt. % Si) were the only aluminum-iron-silicon compositions which could be quenched into the amorphous state at cooling rates of $10^5$–$10^6$ K/sec. No consolidation data or mechanical properties were reported for the alloys discussed in this paper.

The Bayer and Hall-Heroult processes for the extraction of alumina from bauxite, and the production of liquid aluminum by electrolysis of alumina has been the main commercial process for producing aluminum. Extensive work has been carried out by the major aluminum companies on alternative production methods, using carbothermic reduction of aluminosilicate ores, and electrolysis of refined aluminum chloride. Both processes have been widely researched and numerous patents have been issued, for example:

1. U.S. Pat. No. 3,661,561 "Method of Making Aluminum Silicon Alloys" to F. W. Frey, et al.
2. U.S. Pat. No. 3,661,562 "Reactor and Method of Making Aluminum-Silicon Alloys" to K. K. Seth, et al.
3. U.S. Pat. No. 3,758,289 "Prereduction Process" to J. W. Wood.
4. U.S. Pat. No. 3,758,290 "Carbothermic Production of Aluminum" to R. M. Kirby.
5. U.S. Pat. No. 4,046,558 "Method for the Production of Aluminum-Silicon Alloys" to S. K. Das, and R. A. Milito et al.
6. U.S. Pat. No. 4,053,303 "Method of Carbothermically Producing Aluminum-Silicon Alloys" to C. N. Cochran, et al.

Efforts directed to the commercial carbothermic melting of aluminum have been reviewed by P. T. Stroup in 1964 (Trans. Met. Soc.) AIME, Vol. 230, pp. 356–372.

There have been systematic investigations of the production of pure aluminum from various ores ranging from bauxite (50% $Al_2O_3$, 15% $Fe_2O_3$, 2% $SiO_2$), which has highest available alumina content, to various clays and feldsparthic decomposition weathering products, which have generally higher silica and iron oxide contents and lower alumina contents. In general, reduction to pure aluminum is the most difficult carbothermic reaction, with reduction to aluminum-silicon alloys having more attractive reaction kinetics. During the 1960's, for example, Reynolds Aluminum operated a 2MW pilot plant producing aluminum-silicon alloys from the carbothermic reduction of nephaline ores containing 25% $Al_2O_3$, 50% $SiO_2$, 2% $Fe_2O_3$. It has generally been considered that the carbothermic reduction reactions proceed at somewhat lower temperatures when silicon is present, although the understanding of the direct reactions involved are considered somewhat speculative by Stroup.

The presence of iron oxides in the initial ore results in iron being present in the final alloy. As discussed by Das and Milito (U.S. Pat. No. 4,046,558), the presence of iron produces higher product yields by lowering the volatility of aluminum rich reaction products. Das, et al. discuss a method of carbothermic reduction of natural lateritic ores, and synthetic ore mixtures having widely differing chemistries (15–48 wt. % $Al_2O_3$, 2–68 wt. % $SiO_2$, and 3.8–60 wt. % $Fe_2O_3$) The resultant aluminum-silicon alloys contain unspecified quantities of iron.

Fujishige, et al. (Journal Japanese Inst. Met., Dec. 1983, 47(12), p. 1047–1054) have described carbothermic reduction of aluminous ores with high temperature carbon monoxide, and concluded that bauxite ores with high iron contents represented the most favorable raw materials for carbothermic reduction in a blast furnace.

Kuwahara in U.S. Pat. No. 4,394,167 discloses a method for producing aluminum metal in which alumina, silica and oxide bearing materials are mixed with coal. The mixture is heated to produce alumina bearing, coked briquettes. Then, the coked briquettes are brought to a temperature ranging from 2,000° to 2,100° C. to produce an aluminum, silicon and iron containing alloy. The alloy is scrubbed by a molten lead spray directly after the alloy formation, and converted to a lead-aluminum alloy. Aluminum is separated from lead by liquation and purified by fractional distillation.

In conventional, commercially useful aluminum alloys produced by the Bayer and Hall-Heroult processes, neither the iron nor the silicon content exceeds about 0.1 wt. %. To be commercially competitive, alloys made by the carbothermic direct-reduction processes should have similar iron and silicon levels. In the alloys destined for the aluminum-silicon casting alloy market, however, the Si content can reach 12 wt. % and the iron content may reach 1 wt. %. In alloys contain substantially higher amounts of iron, conventional solidification at cooling rates less than $10^2$ K/sec produces severe microsegregation, in which 10–100 micrometer size Al—Fe—Si intermetallic compounds undesirably embrittle the alloy. As a result, when a carbothermically reduced, aluminum alloy contains more than about 0.1wt. % Fe, the alloy has been further refined employing, for example, dissolution in molten lead to provide a sufficiently ductile alloy that is commercially useful in conventional casting and manufacturing processes. This additional processing increases the costs of the aluminum and the products manufactured therefrom.

SUMMARY OF THE INVENTION

The present invention provides to aluminum-transition metal-silicon alloys containing iron and silicon in quantities substantially greater than that of conventional foundry alloys based on the aluminum-silicon eutectic system. Generally stated, the alloys of the invention consist essentially of the formula $Al_{bal}TM_dSi_e$, wherein "TM" is at least one element selected from the group consisting of Fe, Co, Ti, V, Ni, Zr, Cu, Mg and Mn, "d" ranges from about 2–20 wt %. "e" ranges from about 2.1–20 wt. %, and the balance is aluminum plus incidental impurities. These alloys have a microstructure which varies from a microeutectic to a microcellular structure, depending on the specific alloy chemistry. In alloys of the invention, at least about 50% of the microstructure is composed of the microeutectic and/or microcellular structure.

The invention further provides a method for producing commercially useful aluminum alloy having desired levels of ductility, toughness and tensile strength. In the method, an aluminous material containing oxides of Al, transition metals, Mg and Si is carbothermically reduced to produce an alloy consisting essentially of the formula $Al_{bal}TM_dSi_e$, wherein "TM" is at least one element selected from the group consisting of Fe, Co, Ti, V, Ni, Zr, Cu, Mg and Mn, "d" ranges from about 2–20wt %, "e" ranges from about 2.1–20 wt %, and the balance is aluminum plus incidental impurities. The alloy is placed in the molten state, and is rapidly solidified at a quench rate of at least about $10^6$ K/sec to produce a rapidly solidified alloy in which the microstructure is at least about 50% composed of a microeutectic and/or microcellular structure.

The resultant, rapidly solidified alloy at room temperature (approximately 297K) can have a ductility of at least about 5% elongation to fracture and can have an ultimate tensile strength of at least about 350 MPa. As a result, the rapidly solidified alloys produced in accordance with the method of the invention can be employed to form extrusions and other useful structural members. In addition, carbothermic reduction products composed essentially of Al-TM-Si can be economically and efficiently employed to produce Al alloys having sufficient ductility, toughness and tensile strength for such structural applications.

BRIEF DESCRIPTION OF THE DRAWINGS

The invention will be more fully understood and further advantages will become apparent when reference is made to the following detailed description of the preferred embodiment of the invention and the accompanying drawings in which.

DETAILED DESCRIPTION OF THE INVENTION AND THE PREFERRED EMBODIMENTS

Figure 1:
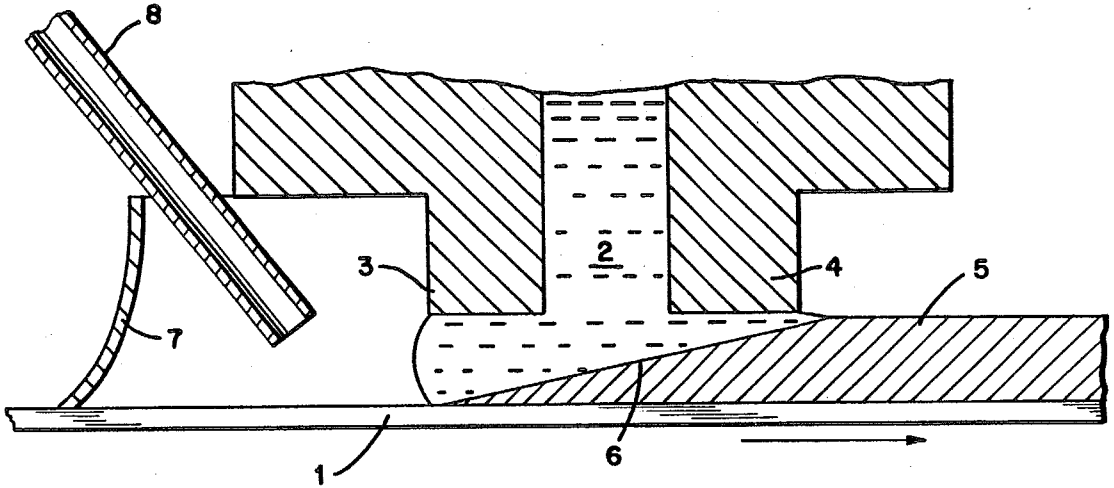
FIG. 1 shows a schematic representation of a casting apparatus employed to cast alloys of the invention.

The chemical reactions involved in the carbothermic reduction of aluminum are discussed in detail by P. T. Stroup, "Carbothermic Smelting of Aluminum", *Transactions Of The Metallurgical Society Of AIME,* Volume 230,April, 1964, pages 356–372, which is hereby incorporated by reference thereto. See in particular, the discussion at pages 359–364.

Aluminous raw materials for the carbothermic reduction process are selected and combined to optimize the desired carbothermic reduction reactions and to produce the desired alloy compositions. For example, a lateritic ore derived from the weathering of dolerite would contain titanium oxides. As a result, the carbothermically reduced alloy would also contain titanium.

As another example, up to about 50 wt % of an aluminum containing compound such as $Al\ Fe_3$ or $Al_2\ O_3$, can be added to calcined bauxite to provide the aluminous raw material for the carbothermic reduction process.

As a further example, selected ratios of silica to alumina ranging from about 0.15 to 1.1, and selected amounts of iron oxide ranging from about 0.5 to 30 wt % can be combined in the manner taught by U.S. Pat. No. 4,053,303 to Cochran, et al. and U.S. Pat. No. 4,046,558 to Das, et al. The iron oxide causes iron to be present in the alloy, which lowers the volatility of the alloy and results in higher product yields.

The resultant carbothermically reduced alloys are generally composed of Al-TM-Si compositions. The precise amounts of the constituent elements will depend upon the composition of the aluminous raw material mix and the reaction kinetics of the carbothermic reduction process.

For optimum efficiency and economy, the aluminous raw material mix and the parameters of the carbothermic reduction reactions are adjusted to provide a resultant alloy composition consisting essentially of the formula $Al_{bal}TM_dSi_e$, wherein "TM" is at least one element selected from the group consisting of Fe, Co, Ti, V, Ni, Zr, Cu, Mg and Mn, "d" ranges from about 2–20 wt. %, "e" ranges from about 2.1–20 wt. %, and the balance is aluminum and incidental impurities. A further aspect of the invention is provided when "d" ranges from about 3–16 wt % and "e" ranges from about 2.5–16 wt %. In a particularly advantageous embodiment of the invention, the reduced alloy consists essentially of the formula $Al_{bal}Fe_aSi_bT_c$, wherein "T" is one or more elements selected from the group consisting of Ni, Co, Ti, V, Zr, Cu and Mn, "a" ranges from about 2–20 wt %, "b" ranges from about 2.1–20 wt. %, "c" ranges from about 0.2–10 wt %, and the balance is aluminum and incidental impurities.

If the carbothermic reduction process has not been optimized, however, the reduced alloy can be modified with suitable additions of Al, Fe, Si, and T group elements to bring the compositions of the constituent elements within the desired ranges. The reduced alloy can be recovered from the carbothermic reduction processing in either the molten or solidified state, as desired, for subsequent processing.

To provide the desired levels of ductility, toughness and strength needed for commercially useful applications, the reduced alloy is subjected to rapid solidification processing, which modifies the alloy microstructure. The rapid solidification processing typically employs a melt spin casting method wherein the alloy is placed into the molten state and then cooled at a quench rate of at least about $10^5$ to $10^7$° C./sec to form a solid ribbon or sheet. This process should include provisions for protecting the melt puddle from burning, excessive oxidation and physical disturbance by the air boundary layer carried along with a moving casting surface. For example, this protection can be provided by a shrouding apparatus which contains a protective gas; such as a mixture of air or $C0_2$ and $SF_6$, a reducing gas, such as CO, or an inert gas; around the nozzle. In addition, the shrouding apparatus excludes extraneous wind currents which might disturb the melt puddle.

FIG. 1 shows a partial cross-sectional, side view of a representative apparatus employed to rapidly solidify the alloys of the present invention. As shown in FIG. 1, molten metal 2 of the desired composition is forced under pressure through a slotted nozzle defined by a first lip 3 and a second lip 4 onto the surface of a chill body 1, which is held in close proximity to the nozzle and moves in the direction indicated by the arrow. A scraping means, including scraper 7, is located in contact with the chill substrate, and an inert or reducing gas is introduced by a gas supply means through a gas inlet tube 8.

Since casting surface 1 moves very rapidly at a speed of at least about 1200 to 2750 meters per minute, the casting surface carries along an adhering gas boundary layer and produces a velocity gradient within the atmosphere adjacent to the casting surface. Near the casting surface the boundary layer gas moves at approximately the same speed of the casting surface; at positions farther from the casting surface, the gas velocity gradually decreases. This moving boundary layer can strike and destabilize the stream of molten metal coming through crucible 2. In severe cases, the boundary layer blows the molten metal stream apart and prevents the desired quenching of the molten metal. In addition, the boundary layer gas can become interposed between the casting surface and the molten metal to provide an insulating layer that prevents an adequate quenching rate. To disrupt the boundary layer, the apparatus employs conditioning means located upstream from crucible 2 in the direction counter to the direction of casting surface movement. In the shown embodiment of the apparatus, this conditioning means is comprised of the scraper means and the supply of inert or reducing gas.

Figure 3:
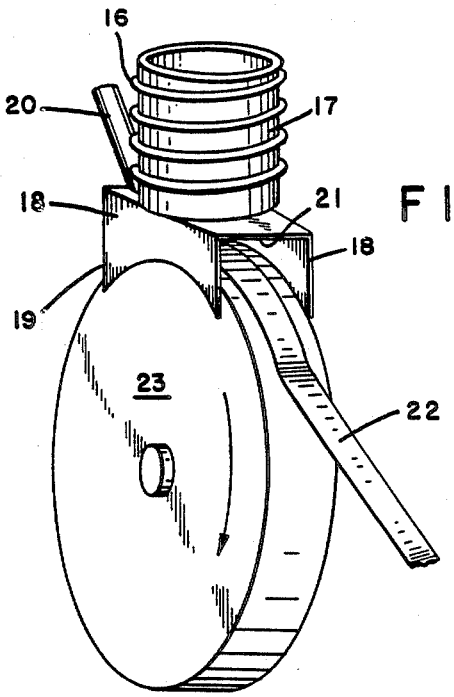
FIG. 3 shows a perspective view of the opposite side of the apparatus shown in FIG. 2.
Figure 2:
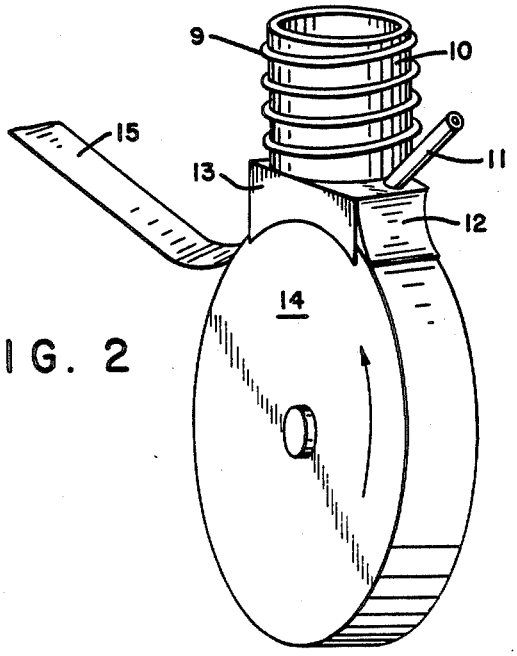
FIG. 2 shows a perspective view of the apparatus employed to produce alloys of the invention.

FIGS. 2 and 3 are simplified, perspective views from two different angles. In particular, FIG. 3 shows how side shields 18 are used in conjunction with the substrate scraper 19 and the gas inlet tube 20 to provide a semi-enclosed chamber around nozzle 21.

The preferred protective gas is carbon monoxide, although other gases such as helium, nitrogen or argon can be used. The advantage of using CO is that it burns, combining with oxygen present around the nozzle to produce hot $C0_2$. The process reduces the oxygen available for alloy oxidation, keeps the nozzle hot and produces a gas of lower density than air.

The presence of the scraper and side shields markedly improves the effectiveness of the CO flame. Without the scraper, the CO tends to burn downstream of the nozzle only. As a result, there is poor melt/substrate contact and the ribbon, if it is formed at all, is thin and full of holes. With a scraper, the flame burns upstream of the nozzle and the gas inlet tube. The scraper effectively removes the air boundary layer and creates a slow pressure area which is filled by the protective gas. Without side shields, however, extraneous wind currents generated by the moving substrate assembly can distort the gas flow so that it does not uniformly impinge upon the nozzle and melt puddle. Under these conditions, the ribbon can be formed nonuniformly. In particular, one or both ribbon edges can be irregular. However, when side shields are used in conjunction with the scraper blade and protective gas, the gas flow pattern is uniform and consistent, and ribbon can be reliably cast.

The precise dimensions and location of the scraping means, gas supply and shielding means are not critical, but several general concepts should be adhered to. The scraping means, gas supply and shielding portions of the casting apparatus, that is, the side shields, scraper blade and gas inlet tube should be selectively located to insure and maintain a uniform gas flow pattern. In general the opening of the gas inlet tube should be located within 2–4 inches of the nozzle. The scraper should be positioned as close as practical to the gas inlet tube to insure that the protective gas flows into the low pressure behind it and not into the ambient atmosphere, and the side shields should be located to extend from the scraper to a point roughly 2–3 inches past the nozzle slot. The shields should be of a sufficient height such that they are close to or in contact with the substrate assembly at the bottom and the underside of the nozzle or nozzle support at the top. The nozzle or nozzle support should be such that when it is in the casting position, the scraper, the side shields and the underside of the nozzle support form a semienclosed chamber around the nozzle slot which maximizes the effect of the inert or protective gas, as representatively shown in FIGS. 2 and 3.

Alloying elements such as silicon, iron, cobalt, titanium and vanadium, have limited solubility in aluminum. Upon rapid solidification processing, the alloying elements form a fine, uniform dispersion of intermetallic phases, such as $Al_{12}Fe_3Si$ and $Al_5FeSi$ depending on the alloy composition. These finely dispersed intermetallic phases increase the strength of the alloy and help to maintain a fine grain size by pinning the grain boundaries during consolidation of the powder at elevated temperatures. The addition of the alloying elements silicon and zirconium contributes to strength via matrix solid solution strengthening and by formation of certain metastable ternary compounds and the stable binary $Al_3Zr$ intermetallic compound.

Rapidly solidified alloys of the invention have a distinctive microstructure. As representatively shown in FIGS. 4–6, at least about 50% of the alloy by volume is composed of a microstructure comprised of a microeutectic/microcellular structure. The remainder of the microstructure is composed essentially of aluminum dendrites or cells (not shown) with a secondary dendrite arm spacing or cell spacing of about 1 micrometer. Alloys of the invention containing high amounts of Fe and low amounts of Ti and Zr will have the microeutectic structure. Alloys containing low amounts of iron and high amounts of Ti and Zr will have the microcellular structure. Alloys between the extremes will have a mixture of the structures.

Figure 4:
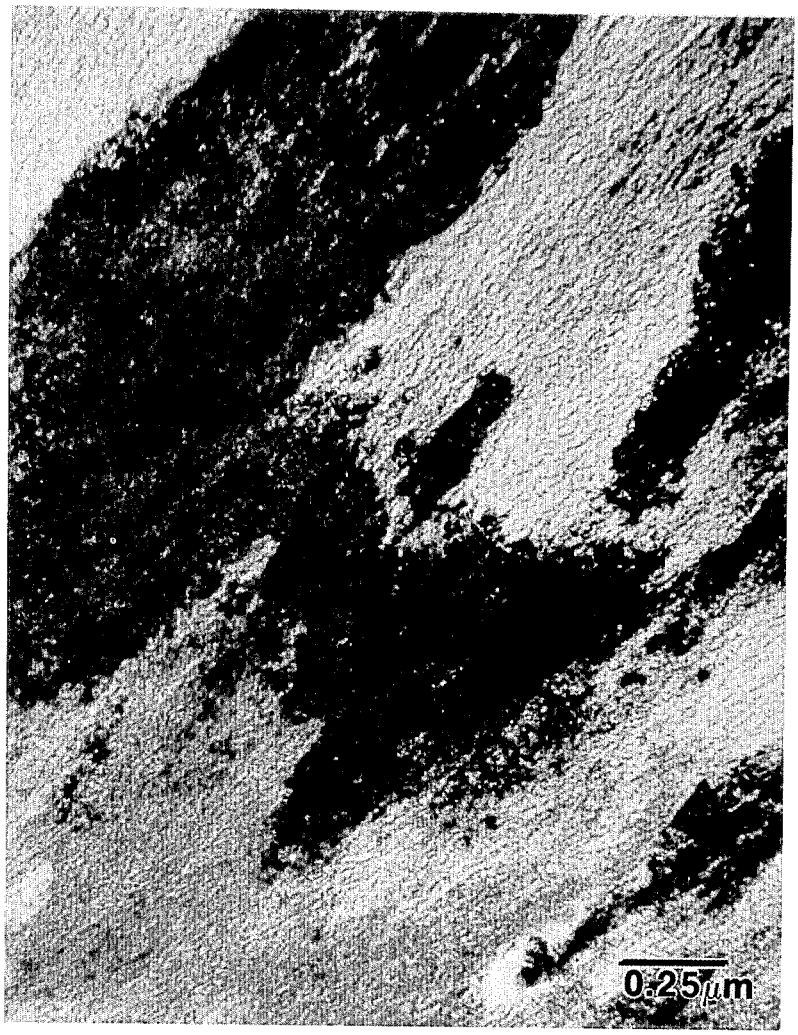
FIG. 4 shows a representative transmission electron micrograph of an alloy which has a microeutectic structure.

In FIG. 4, the large contrasting dark regions and light regions are caused by electron diffraction effects and are not related to differences in the intrinsic structure of the alloy (Al-8Fe-2Zr-1Mo-1.3Si). Referring to the large, lighter-colored band region in the upper right quadrant of FIG. 4, the microeutectic microstructure can be seen as a substantially two-phase structure composed of a substantially uniform, fibrous network of complex intermetallics in a supersaturated, aluminum solid solution matrix. The intermetallic, darker colored, fibrous phase, located within the matrix, is comprised of extremely stable precipitates of very fine fiber-like, metastable intermetallics. These intermetallics measure about 10–100 nanometers in their narrow width dimension (fiber diameter), and are composed of aluminum and other metal elements. The intermetallic phases are substantially uniformly dispersed within the microeutectic structure and intimately mixed with the aluminum solid solution phase, having resulted from a eutectic-like solidification.

In the microcellular structure (FIG. 6), at least about 90% of the alloy elements are in a supersaturated, aluminum solid solution. Remaining amounts of the solute elements are distributed in the microcellular boundary regions as fine, crystallographically complex, metastable intermetallic compounds. As representatively shown in FIG. 6, the microcellular cells in a representative alloy (Al- 3Si-10Zr) measure about 0.1–0.5micrometers across, and have a common growth direction, which is approximately perpendicular to the plane of the figure.

Figure 5:
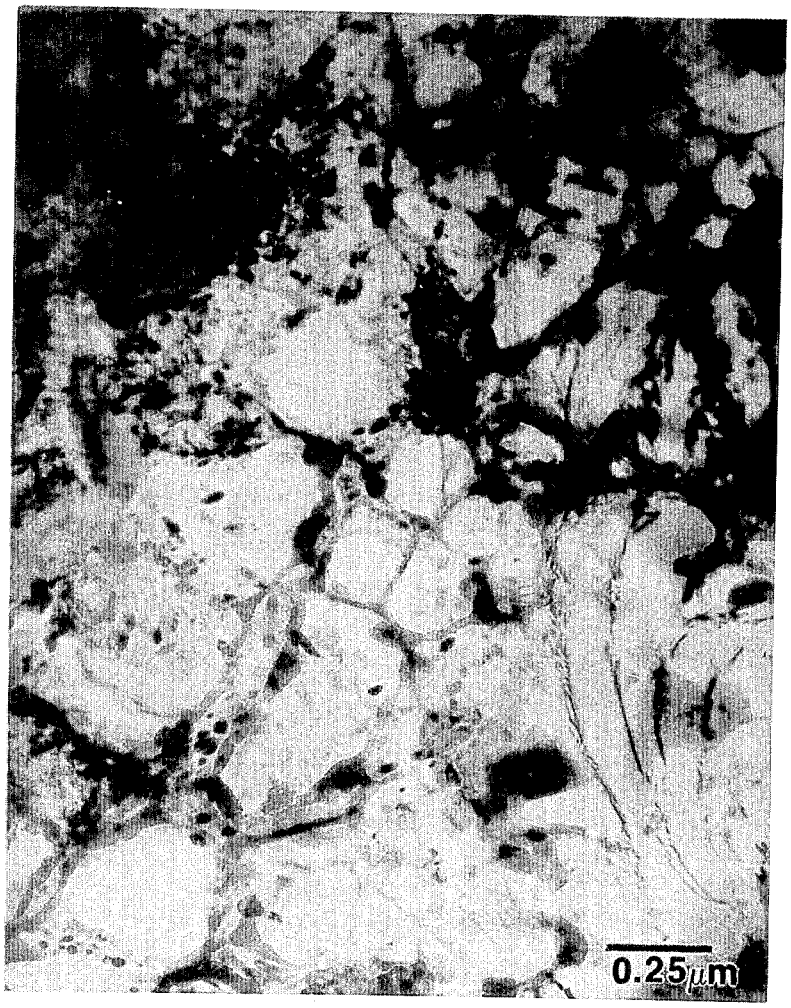
FIG. 5 shows a representative transmission electron micrograph of an alloy which is a mixture of a microeutectic structure and a microcellular structure.
Figure 6:
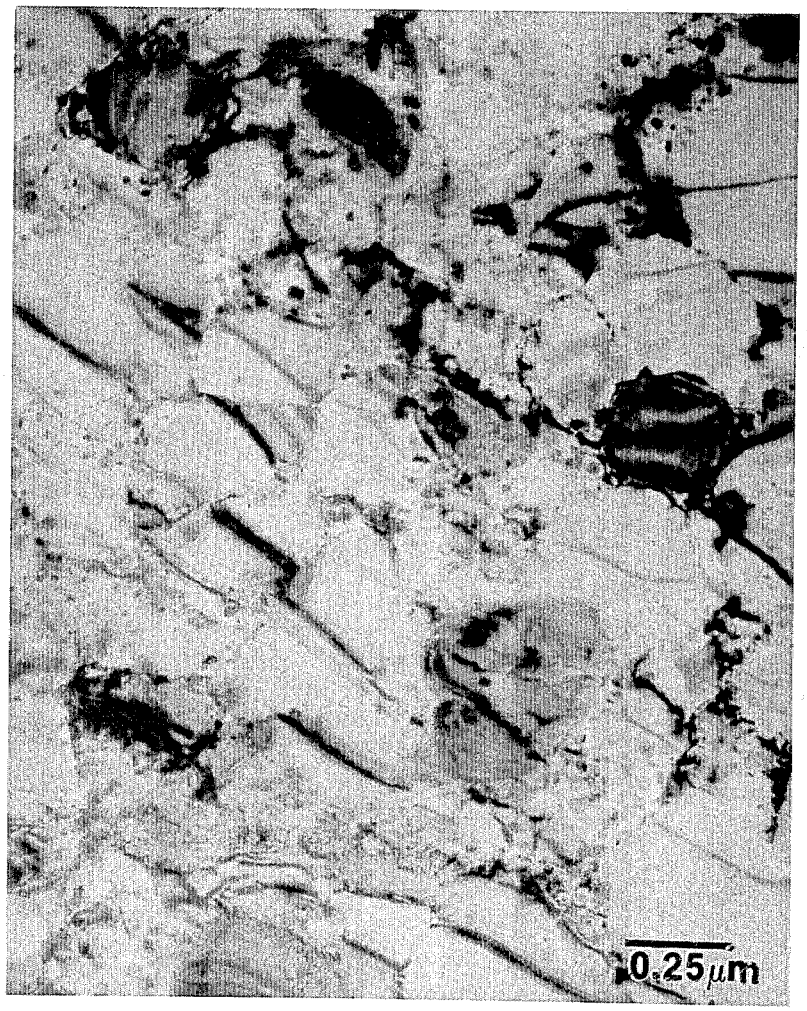
FIG. 6 shows a representative transmission electron micrograph of an alloy which has a microcellular structure.

As representatively shown in FIG. 5, certain alloys of the invention, such as Al-5.8 Si-9.5 Ti, can have a microstructure composed of a mixture of the microeutectic structure and the microcellular structure.

A further aspect of the invention is an alloy of the invention wherein the microstructure is at least about 90% microeutectic and/or microcellular. Even more advantageous is an alloy which has a microstructure that is approximately 100% microeutectic and/or microcellular.

The distinctive microeutectic/microcellular microstructures are capable of providing a ductility of at least about 5% elongation to fracture and can provide an ultimate tensile strength of at least about 350 MPa both measured at room temperature (about 297K) when particles of the alloy are consolidated together to form a desired article of manufacture. The rapidly solidified alloys of the invention can be processed by conventional techniques, such as hot extrusion, to provide structural members. These structural members include, for example, architectural sections, and are useful at ordinary temperatures below about 200° C. (473K).

The following examples are presented to provide a more complete understanding of the invention. The specific techniques, conditions, materials, proportions and reported data set forth to illustrate the principles and practice of the invention are exemplary and should not be construed as limiting the scope of the invention. The alloy chemistries are expressed as nominal compositions.

EXAMPLES 1–11

The following rapidly solidified alloys have been prepared. The amounts are expressed in weight percent:

1. Al-10 Fe-2.5 Si
2. Al-10 Fe-5 Si
3. Al-16 Fe-3 Si-1 Co
4. Al-10 Ti-16 Si-3 V
5. Al-10 Ti-8.5 Si
6. Al-8.5 Ti-3.5 Si
7. Al-10 Ti-8.5 Si-3 V
8. Al-2.8 Si-15.1 Zr
9. Al-10 Ti-16 Si-3V
10. Al-5.8 Si-9.8 Ti
11. Al-3 Si-10 Zr

EXAMPLES 12–20

Rapidly solidified alloys of the invention were compacted into consolidated articles by hot pressing and extrusion. The articles had the mechanical properties set forth in the following Table I.

TABLE I

| Alloy | Temp (K) | UTS (MPa) | Fracture Strain (%) |
|---|---|---|---|
| Al—2.5Si—10Fe | 297 | 507 | 10 |
| | 449 | 387 | 5.6 |
| Al—5Si—10Fe | 297 | 516 | 5.9 |
| | 449 | 345 | 9.8 |
| Al—16Fe—3Si—1Co | 297 | 504 | 3.0 |
| | 449 | 553 | 0.7 |
| Al—10Ti—8.5Si—3V | 297 | 478 | 7.3 |
| | 449 | 288 | 8.1 |
| Al—8.5Si—10Ti | 297 | 491 | 6.2 |
| | 449 | 317 | 10.8 |
| Al—3Si—8.5Ti | 297 | 348 | 13.7 |
| | 449 | 247 | 13.5 |
| Al—6.1Si—9.9Zr | 297 | 363 | 19.1 |
| | 449 | 252 | 13 |
| Al—2.8–15.1Zr | 297 | 390 | 14 |
| | 449 | 266 | 13 |
| Al—10Ti—16Si—3V | 297 | 506 | 2.8 |
| | 449 | 278 | 8.1 |

Having thus described the invention in rather full detail, it will be understood that these details need not be strictly adhered to but that various changes and modification may suggest themselves to one skilled in the art, all falling within the scope of the invention as defined by the subjoined claims.

We claim:

1. A method for producing aluminum alloy, comprising the steps of:
   (a) a carbothermically reducing an aluminous material containing oxides of Al, Si, and transition metals to provide a reduced material;
   (b) producing with said reduced material an alloy consisting essentially of the formula $Al_{bal}TM_dSi_e$, wherein "TM" is at least one element selected from the group consisting of Fe Co, Ti, V, Ni, Zr, Cu, Mg and Mn, "d" ranges from about 2–20 wt %, "e" ranges from about 2.1–20 wt % and the balance is aluminum and incidental impurities;
   (c) placing said alloy in the molten state; and
   (d) rapidly solidifying said alloy at a quench rate of at least about $10^6$ K/sec to produce a rapidly solidified alloy in which the microstructure is at least about 50% composed of a microeutectic and/or microcellular structure.

2. A method as recited in claim 1, wherein said alloy is produced by adding selected amounts of Al, Si and TM group elements to said carbothermically reduced material.

3. A method as recited in claim 1, wherein said aluminous material is bauxite.

4. A method as recited in claim 1, wherein said solidifying step (d) produces a rapidly solidified alloy in which the microstructure is at least about 90% composed of a microeutectic and/or microcellular structure.

5. A method as recited in claim 1, wherein said solidifying step (d) produces a rapidly solidifed alloy in which the microstructure is approximately 100% composed of a microeutectic and/or microcellular structure.

* * * * *